United States Patent [19]

Le Vantine

[11] Patent Number: 4,768,126

[45] Date of Patent: Aug. 30, 1988

[54] SELF-CONTAINED DEVICE FOR REMOVING STATIC CHARGE, DUST AND LINT FROM SURFACES

[76] Inventor: Allan D. Le Vantine, 18225 Rancho St., Tarzana, Calif. 91356

[21] Appl. No.: 79,720

[22] Filed: Jul. 30, 1987

[51] Int. Cl.[4] ..... H05F 3/06

[52] U.S. Cl. ..... 361/213; 361/231

[58] Field of Search ..... 361/212, 213, 214, 220, 361/229, 230, 231

[56] References Cited

U.S. PATENT DOCUMENTS

| | | | |
|---|---|---|---|
| 3,335,272 | 8/1967 | Dickinson et al. | 361/231 |
| 4,194,232 | 3/1980 | Cumming et al. | 361/213 |
| 4,213,167 | 7/1980 | Cumming et al. | 361/213 |
| 4,258,408 | 3/1981 | Cantelli | 361/213 |
| 4,333,123 | 6/1982 | Moulden | 361/213 |
| 4,370,695 | 1/1983 | Penick | 361/213 |
| 4,498,116 | 2/1985 | Saurenman | 361/213 |
| 4,502,091 | 2/1985 | Saurenman | 361/213 |
| 4,517,143 | 5/1985 | Kisler | 361/221 |
| 4,635,161 | 1/1987 | Le Vantine | 361/213 |

*Primary Examiner*—L. T. Hix
*Assistant Examiner*—Brian W. Brown

[57] ABSTRACT

A device for removing static charge, dust and lint from surfaces by use of electrically ionized high velocity air. The device generates high air velocities by means of high speed centrifugal impellers. The air from the impellers is passed through ducts to an ionizing section where it is electrically ionized, by high voltage emitters, and then directed through a nozzle means to exit the device to the adjacent atmosphere. Upon coming in contact with a statically charged surface, the ionized high velocity air neutralizes the static charge and convects away any dust or lint adhering thereto.

3 Claims, 2 Drawing Sheets

FIG. 4
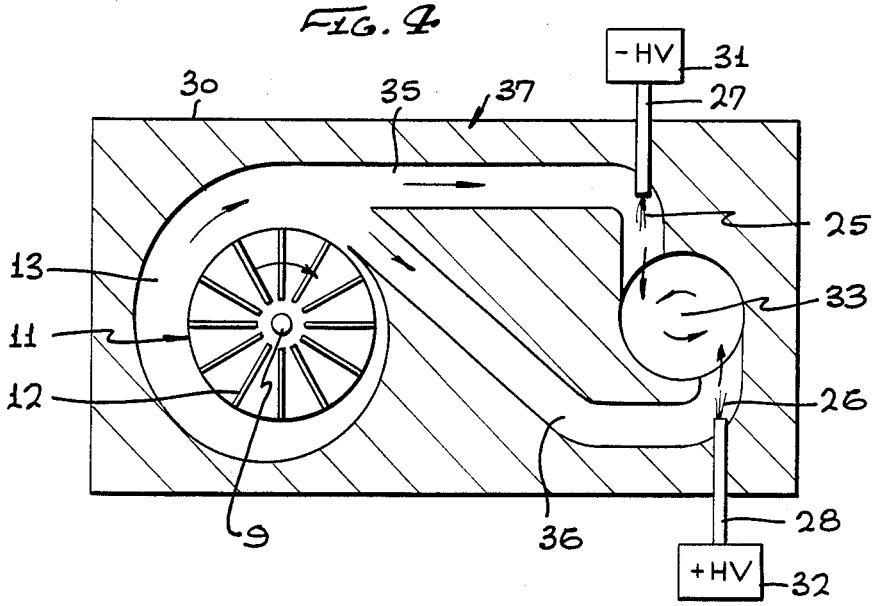
FIG. 5
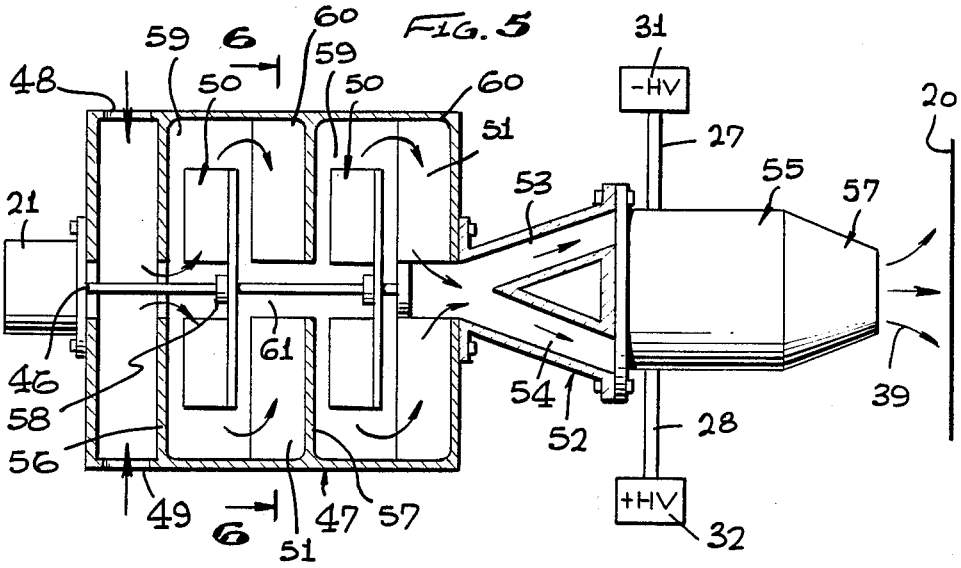
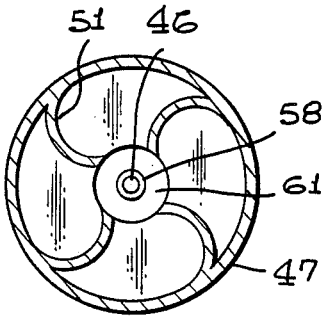
FIG. 6

SELF-CONTAINED DEVICE FOR REMOVING STATIC CHARGE, DUST AND LINT FROM SURFACES

BACKGROUND OF THE INVENTION

1. Field of the invention:

This invention relates to the removal of static charge, and also dust and lint simultaneously from surfaces. In many industries the elimination of the static charge which accumulates on electrically non-conductive surfaces is of utmost importance. This static charge binds dust and lint particles to these surfaces and is counterproductive to the process of the particular industry. The buildup of static charge in capacitive bodies can also precipitate detrimental effects in many commercial areasm. An example of the former is the photo-processing industry, where positive prints are made from photographic negatives. It is necessary to keep these negatives free from dust and lint so that the dust and lint are not imaged on the prints making them unacceptable. An example of the latter is the electronic industry where static charge build-up can affect and damage sensitive solid state electronic components.

2. Description of prior art:

Over the years several methods have been devised to eliminate static charges by making the surrounding air electrically conductive thus allowing the static charges to be conducted away from the affected area. These include such techniques as vaporizers and atomizers to humidify the air, radio-active materials to ionize the air, and also high voltage emitters to ionize the air. Other methods which make direct contact with the surface have been used such as anti-static brushes and wipers and liquids which are applied directly to the surface.

Static charge on a non-conductive plastic surface develops usually as the result of contact with another plastic surface or item. Such pastic surfaces or items in contact have an atomic attractive force that holds them together. This force is electric in nature and is of the variety that holds materials together. Separation of the items results in a rending of some of the negatively charged electrons of the atoms from one of the surfaces by the strong attractive force of the other and the adherence of those electrons to that surface. Thus, the surface that has lost electrons is left with an electric charge to again attract negatively charged electrons, and has thereby acquired a positive charge. And, the surface which has gained a surplus of electrons has thereby acquired a negative charge.

This is a classic example of how static charges develop. However, static charges are known to develop in many ways and on surfaces and bodies that do not fit the above example. Static charges are transferable through conductive means such as in the Van de Graff generator or by accumulation of charge on an electrically isolated body through friction means such as an aircraft or a car by friction with the passing air. Charges can also be accumulated from direct contact with high voltage sources or by transmission from a surrounding ionized atmosphere.

Except in a vacuum, static charges tend to dissipate, or leak off through the conductivity of the surrounding atmosphere. The more conductive the atmosphere, the faster the charge will leak off. In humid weather, the moisture in the air makes the air more conductive than in dry weather when there is little moisture in the air.

Thus, we seldom encounter static charge on a humid day and frequently encounter it on a dry day.

Static charges are transferable. Static charge acquired by our clothing is transferred to our body or parts of our body. And, when we approach on object of different potential, we experience an electric discharge as electrons arc from our finger to that object. Static charge can also be transferred from our bodies to tools or other items we contact. These items can in turn impart the charge to a sensitive component, causing damage.

As a general discussion in the elimination of static charge, let us consider the static charge on a plastic film surface. If the surface is placed in an environment of ionized air, it will acquire an equilibrium with the charge of the air. If the surface is of opposite charge, and the air has sufficient energy, the surface will first be neutralized and then equalize with the charge of the air. If there is not sufficient energy in the air, some of the charge will remain on the surface. If the surface is of the same charge as the air, the end charge on the surface will be equal in potential to the end charge on the air.

However, these examples do not occur in bounded isolated reqions, therefore they are continually subject to reactions with the surrounding environment. The initial charge on the air is continually being dissipated to the surrounding environment. The walls or other boundaries of the environment continually absorb and deplete the original charge. Thus, an ionized charge on air rapidly decreases. The film with a surface charge inserted into a chamber with the air at an initial charge, will first equalize with the charge of the air and then lose its charge as the charge on the air dissipates to the chamber walls.

This physical occurance, which can be referenced as the "bleed-off technique", provides an excellent means for eliminating static charge for many applications. However, there are applications where this method is impractical to apply or is not possible to incorporate because of the inclusion of other objectives. One such application, and one which is imposed by the objectives of this invention, is the removal of dust and lint from surfaces of film by use of high velocity air flow simultaneous with the elimination of the static charge, to instantly clean and neutralize a surface passing by the device.

High velocity air passing over a surface is turbulent. Hence, it disrupts singly ionized (positive or negative) neutralizing air making the "bleed-off technique" ineffective. The results are non-uniform leaving portions of the film with a significant residual charge either that of the original charge on the film or that of an induced charge transferred to the film by the ionized air at its initially high potential ionized state. The foregoing occurs whether or not the high velocity air has been ionized either positive or negative with the exception of the application of one specific design technique.

The design exception is the use of alternating fields of positive and negative ionized air. Adjacent fields of opposity polarity quickly neutralize each other, if the opposing fields are properly spaced so that they interact with the surface as well as each other before neutralization occurs. In this way the surface is neutralized along with the annihilation of the charges on the air.

Previous art in this technique is used by Cumming et al, U.S. Pat. No. 4,194,232. In this application air is impressed on a film surface through small holes which have needles projecting through their centers. The needles are supplied with high voltage from an alternating source and serve to ionize the air passing out of the holes. The frequency of the high voltage source is sixty hertz alternating between positive and negative and shows that the field spacing produced by sixty hertz is very effective for this application. Cumming et al also use this technique in another design U.S. Pat. No. 4,213,167.

Attempts have been made to produce the effects of an alternating high voltage air ionizing techniques by using separate constant positive and negative high voltage sources. These techniques incorporate alternately spaced positive and negative ionizing elements. Even though patents on such designs have been issued, U.S. Pat. Nos. 4,498,116 and 4,502,091, to Sournman and 4,333,123, to Moulden experiments show that these designs do not prove to be effective when directed perpendicular to the plane surface, from which the static charge and dust are to be removed.

The deficiency with these systems is that there is not adequate or uniform mixing of the positive and negative ionized regions to bring about a zero net charge in contact with the surface of the film. This leaves the film with residual or induced charges after it has been passed by the system.

However, my previous invention U.S. Pat. No. 4,653,161 does provide the uniform mixing of positive and negative ionized air streams, required, in a vortex chamber so that it does produce a zero net charge at the film surface and does provide neutralization of the stataic charge.

In all of the afore-mentioned systems, the source of air to convect away the dust and lint is provided from a separate and apart compressed air or gas source such as that derived from an air compressor or a high pressure gas bottle. There has been no legitimate attempt to remove the dust and lint through convection by any other convective means, or means that is integral with the performing unit. Although Moulden U.S. Pat. No. 4,333,123 does use a fan in one version of his system, the velocity of the air provided by a fan, as conceived and described, is inadequate to remove the dust and lint from a plane surface. Further, in close proximity his system will not provide complete neutralization of the surface charge, as this system was devised as a static eliminator for a work area (probably for electronic assembly).

Experimentation has shown that air velocities on the order of 100 feet per second are the minimum required to provide the degree of convection that is needed to satisfactorally remove dust and lint from film for the photographic industry. Convective velocities from compressed air or gas sources can be two to three times these velocities or 200 to 300 feet per second. My invention embodies such a self-contained system and is described as follows.

SUMMARY OF THE INVENTION

Accordingly it is an objective of this invention to provide an improved device for the simultaneous elimination of static charge, dust and lint from plane surfaces.

It is another objective of the invention to eliminate static charge by the use of air that has been ionized both positively and negatively.

It is also an objective of this invention to remove the dust and lint by the application of high velocity air.

It is a further and fundamental objective of this invention to generate, within the device, the high velocity air for distributing the ionized air and the dust and lint removing air.

It is also an objective of this invention to generate the high velocity air by the use of single or multi-stage high speed impellers.

The above and other objectives of this inventioon are achieved in accordance with the following aspects thereof.

The primary air moving element of the invention is a small compact means for generating a flow of air through a small aperture at sufficiently high velocity to blow dust and lint from a surface. The means for moving air in this invention is accomplished by the use of a centrifugal impeller operated at an extremely high rate of rotation. The embodiments described here use a two inch diameter impeller operating at 20,000 RPM. At these speeds the impeller will generate an unimpeded flow of air, at the take-off scroll-housing of the impeller, in excess of 10,000 feet per minute. However, the necessity of confining and directing the air flow through ducting means will reduce this rate to between sixty and seventy percent of that figure or about 6,000 to 7,000 feet per minute. There are the kinds of velocities of air that are needed to convect dust and lint from a surface.

The take-off air from the impeller scroll-housing is directed through such ducting, past an air ionizing means and then through a nozzle or directing means out of the device and to the work area to be treated.

In a first embodiment of the invention, the high velocity air from the centrifugal impeller is ducted past a high voltage emitter means which ionizes the air. The emitter means is connected to a high voltage source by an electrical conductor which provides the electrical power to energize the emitter means. Conventionally the high voltage source provides alternating positive and negative voltages so that the emitter means alternately ionizes the air positively and negatively. This alternation is necessary to give high velocity air a static neutralizing capability.

The ionizing emitters consist of many fine wires fashioned into a brush-like arrangement, attached to the end of the high voltage conductor. Although prior art emitters utilize needles with fine points, it has been found that non-erosive wire of small diameter make more effective and longer lasting emitters. The emitters used in this invention are made from two-thousandth of an inch in diamter of platinum wire. Each brush contains ten free wire ends.

The inoized air is then ducted in a non-turbulent flow out of the device to the work area, so that upon impinging on a surface area it will become turbulent and neutralize the static charge, by the effect of the electrically conductive property of the ionized air, and then convect away the dust and lint, which may have been held to the surface by the original static charge.

In a second embodiment of the invention, the air flow from the centrifugal impeller is divided into two streams and ducted to diametrically opposite tangential inlets to a vortex mixing chamber. Prior to entering the vortex chamber, the air in each of the streams flows past a high voltage emitter means. The emitter means in one stream is supplied with a positive voltage from a positive high voltage source and the emitter means in the other stream is supplied with negative voltage from a negative high voltage source. Thus, one stream entering the vortex chamber is ionized positive and the other stream is ionized negative. The two streams form a vortex of interlaced positively and negatively ionized air which exits one end of the chamber to the work area. Thus, a static neutralizing atmosphere is produced along with a high velocity vortex stream which removes any static charge from the work surface area and convects away any dust or lint adhering thereto.

A third embodiment of the invention utilizes a multi-stage centrifugal impeller arrangement. In this embodiment two or more high speed impellers are connected in series by ducting means such that the out flow of the first impeller is directed to the inflow of the next centrifugal impeller, and so on. By this method the air pressure produced by the second imepller is added to the pressure produced by the first impeller and so on. By this means pressure, primarily, can be increased beyond that which would be practical with a single impeller. After flowing through an ionizing means, such as that described in the second embodiment, the accumulated pressure from the multi-stage arrangement can be converted to produce even higher velocities by passing the air stream through a nozzle means. Such higher velocities provide this embodiment with a greater dust and lint removing capability than the single impeller embodiments.

It should be recognized that the above embodiments can be used alone or incorporated into specialized devices for specific applications. A single device or a multiple array of devices could be mounted across a moving sheet of plastic film to remove the static charge as the sheet passes. Two units could be mounted with their out flows opposing each other so that a strip of photographic film passed between them would be cleaned of dust and lint as well as static charge. An individual unit could be hand-held and directed to eliminate dust, lint and static charge wherever directed. These are a few of the immediately recognizable uses to which this invention can be applied.

BRIEF DESCRIPTION OF THE DRAWINGS

The above embodiments of the invention may be more fully understood from the following detailed description taken together with the accompanying drawings wherein similar reference characters refer to similar elements throughout and in which:

FIG. 4 is a sectional view of block along line and in direction 4—4 of FIG. 3.

FIG. 5 is a partially sectional view of a third embodiment of the invention which features a multi-stage centrifugal impeller arrangement.

FIG. 6 is a sectional view along line and in direction 6—6 of FIG. 5.

DESCRIPTIONS OF PREFERRED EMBODIMENTS AND APPLICATIONS

The embodiments of the invention are envisioned but not limited to those described. It should be recognized that other designs can be used to accomplish the unique principles set forth here. Different techniques for creating the high velocity air could be used, different designs for the ducting of the air are conceivable, and alternate methods for introducing the ionized air can be perceived. Moreover, the invention is not limited to the applications described.

Figure 2:
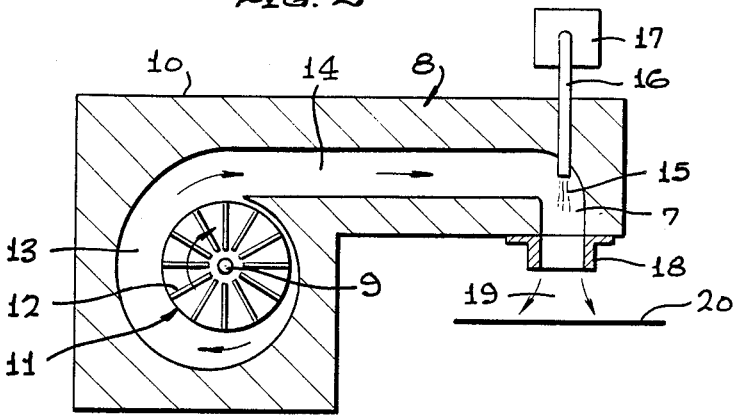
FIG. 2 is a sectional view of block along line and in direction 2—2 of FIG. 1.
Figure 1:
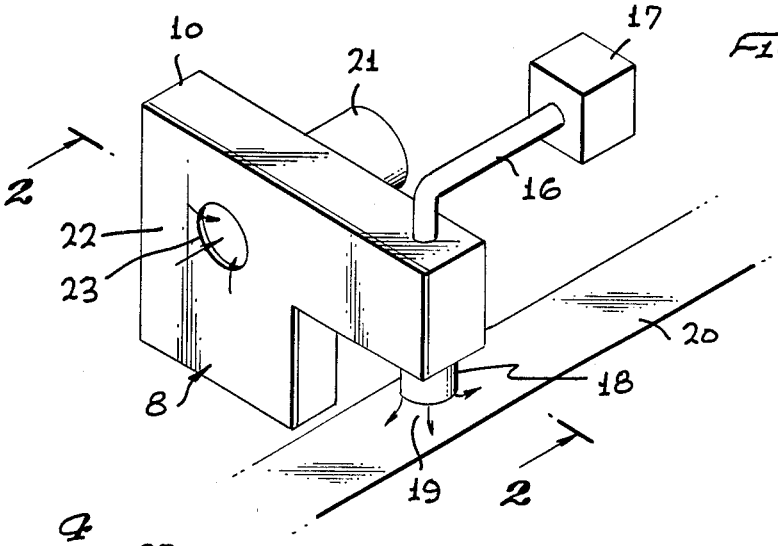
FIG. 1 is a perspective view of one embodiment of the invention.

Referring to the figures, the first preferred embodiment of the invention is shown in FIGS. 1 and 2. It is enclosed in a housing means 8 which is comprised of a block 10 a cover plate 22 and a nozzle 18 all fashioned from electrically non-conductive material. Internally, the block 10 is recessed 13 and 14 to provide for the location of a centrifugal impeller 11 and air pathways for the movement of air through the device. Affixed to one side is a motor means 21 with motor shaft 9 projecting into the housing means at the center of the scroll portion of the recess 13 which is designed with a linear expanding shape for the installation of the centrifugal impeller 11. The centrifugal impeller is affixed to the end of the motor shaft so that it will rotate with the motor. The impeller has radial veins 12 extending from its hub to its circumference to impart a rotating motion to the air within the scroll recess as the rotor turns. The rotation centrifugally forces the air from the impeller to flow outwardly into duct 14.

Emitters 15 for ionizing the air are located within ionizing section 7 at a position a short distance upstream from direction means 18. Emitters 15 are supplied withy a high A.C. voltage from a high voltage source 17 through electrical conduction means 16.

Cover plate 22 covers the recessed face of block 10 selaing the recesses forming the defined channels for the passage of air. And nozzle 18 is affixed to the air outlet to direct the air to the work area 20.

In operation, air enters the scroll recess through opening 23 in cover plate 22. Impeller 11 being rotated at a high angular rate by motor 21 accelerates the air to a high velocity causing the air to flow from the scroll portion of the recess into the duct portion of the recess and past the emitters, where the air is ionized alternately positive and negative. From there it flows through the directing means to the work area. Sections 7 and 18 are of constant cross section, and smooth walled to promote non-turbulent flow. On impinging on the work area these waves of alternating ionization provide a static charge neutralizing capability to the air. Simultaneously, the high velocity of the air convects away any dust that may be adhering to an item in the work area.

Figure 3:
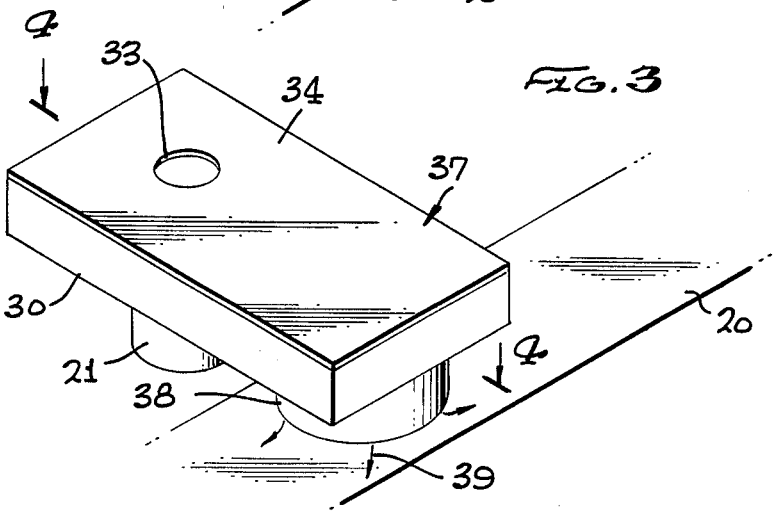
FIG. 3 is a perspective view of a second embodiment of the invention.

A second embodiment of the invention is shown in FIGS. 3 and 4. This embodiment is enclosed in a housing means 37 comprised of a block 30, a cover plate 34 and a nozzle 38. The block is recessed on one side to provide for the location of a centrifugal impeller and passageways for the movement of air. These recesses are identified by location FIG. 4 as a scroll 13 for the impeller 11, ducts 35 and 36 for the passage of air from the impeller scroll to vortex chamber 33. A motor 21 is affixed to the block 30 on the side opposite the recesses and aligned with impeller 11. Motor 21 having a shaft 9 that projects into the recess and to which impeller 11 is rigidly attached, so that the motor will rotate the impeller.

Emitters 25 and 26 are located extending into the ducts 35 and 36 are so located to ionize the air immediately prior to its entrance into the vortex chamber. Emitters 25 are supplied from a negative high voltage soucrce 31 via electrical conductor 27. Emitters 26 are supplied from a positive high voltage source 32 through electrical conductor 28.

The recessed side of block 30 is closed by cover plate 34 rigidly affixed to seal the recesses providing sealed channels for the passage of air. Cover plate 34 has one opening in line with the center of impeller 11 for the inlet of air to the impeller. Nozzle 38 is affixed to the open end of vortex chamber 33 to direct the air outflow to work area 20.

In operation, air enters scroll recess 13 through opening 33 in cover plate 34. Impeller 11 being rotated at a high angular rate by motor 21 accelerates the air to a high velocity causing the air to flow from the scroll portion of the recess into the duct portions of the recess. Air flowing into one duct is ionized negatively by negative emitters 25 prior to entering vortex chamber 33, and air flowing into the other duct is ionized positively by positive emitters 28 prior to entering the vortex chamber. After the mixing of the positive and negative streams of air in the vortex chamber (as per my invention U.S. Pat. No. 4,653,161) the flow is directed to the work area 20 by nozzle 38. The compositely ionized air 39 impinging on the work area neutralizes any static charge and simultaneously, by reason of the high velocity of the air, convect away any dust or lint that may be present in the work area.

A third embodiment of the invention is shown in FIG. 5 and a section along line 6—6 shown in FIG. 6. This embodiment utilizes a multiplicity of centrifugal impellers to produce a higher pressure air flow which can be converted, through a constricting output nozzle, to a higher velocity output than would be normally developed by means of a single impeller. FIG. 5 shows a two stage impeller arrangement of this embodiment. The housing means is comprised of three sections, a cylindrical impeller housing section 47, a duct section 52 and an ionizing section 55 with a nozzle 56. The sections are bolted together to be essentially one rigid unit. On the end opposite the Nozzle a drive motor is attached such that motor shaft 46 extends axially through the center of housing 47. Rigidly affixed to shaft 46 are two impellers 50 in individual cavities separated by partitions 56 and 57. Each partition has a circular opening at its center to allow for the passage of air and the motor shaft. Each cavity is divided into two sections, and impeller section 59 and a diffuser section 60. The impeller section provides space for the impeller to rotate. The diffuser section presents radial splines 51 which are continuous with partitions 56 and 57 and extend from the central hole to the housing wall. The housing 47 has a multiplicity of openings 48 and 49 for the inlet of air, and an opening for the outlet of air to the duct section.

The duct section connects the housing section to the nozzle section. As shown in this embodiment it contains two ducts 53 and 54. However, it may contain a single duct or a multiplicity of ducts as called for by the type of air ionizing system used.

The ionizing section 55 contains the air ionizing emitters as well as the constricting nozzle. In the embodiment shown a dual ionizatin system providing both positive and negative ionization is used. However, a single alternating current high voltage ionization may be employed.

In operation motor 21 rotates impellers 50 at a high angular rate. Air enters housing 47 through openings 48 and 49, passes through the central opening in partition 56 where it is accelerated to a high velocity by the first impeller 50. The air flows from the outer edge of the impeller into diffuser 60 where the air is directed to the center hole 61 of partition 57. The air is then accelerated again by the second impeller 50 from whence it flows into the second diffuser section 60 and then to the outlet opening into the duct section. The air accelerated and compressed by the centrifugal forces developed by the impellers is imparted to the air, each in turn adding to the pressure developed by the previous stages. The resulting high pressure air entering the duct section is directed to the nozzle section. A nozzle so designed that it constricts the air flow through a smaller opening than the opening into the ducts will produce a high air pressure upstream of the nozzle. By the proper selection of smooth flow contours through the bore of the nozzle this high pressure air can be converted to high velocity air with highly directional characteristics along the axis of the nozzle.

While the principles of the invention are thus disclosed and three embodiments are described in detail, it is not intended that the invention be limited by such. It should be recognized that many modifications will occur to those skilled in the art which underlies the scope of this invention and that the invention cover such modifications and be limited only by the appended claims.

What is claimed is:

1. A static charge and dust and lint removing device comprising:

a housing means for enclosing and supporting the elements of the device, said housing means being made of electrically non-conductive material and being generally rectangular in shape and of sufficient depth to enclose the components of the device, said housing means having an inlet opening to allow air to flow into the device and an outlet opening to allow air to flow out of the device, an impeller means within the housing means to receive air from the inlet opening and for accelerating the air to high velocities, said impeller means comprising a circular disc of finite thickness with a central hub for attachment to a rotation means and with veins perpendicular to the plane of the circular disc extending radially from a central region to the circumference of the disc, a rotation means comprising a motor means affixed to the housing means with the motor shaft anchored in the hub of the impeller means such that the motor means will drive the impeller means about its axis of rotation, a scroll means within the housing means for surrounding the impeller means so as to collect and channel the air from the impeller means to a duct means, a duct means within the housing means to provide a passageway for the air to flow from the scroll means to an ionizing section, said duct means comprising two separate passageways each passageway entering the ionizing section at a separate location, an ionizing section for the positioning of emitters in the air flow, said ionizing section comprising a cylindrical vortex chamber with the duct inlets each entering the chamber at one end tangentially at diametrically opposite locations of the cylinder and with means for the location of the emitters within the duct inlets to the vortex chamber and with the opposite end of the cylindrical vortex chamber open to allow for the exit of the air flow, an emitter means mounted within the ionizing section for inducing an ionized charge to the air passing therethrough, said emitter means consisting of a plurality of fine wires, each less than one ten thousandth of an inch in diameter, formed into a brush and metallically bonded to a supporting means which is also an electrical conductor for providing connection to a high voltage source, a nozzle or directing means affixed to the outflow opening of the ionizing section for directing the air out of the device and to the work area, an electrical high voltage source means comprising both a positive direct current high voltage source and a negative direct current high voltage source, the positive high voltage source being connected to one emitter by an electrical conduction means and the negative high voltage source being connected to the other emitter by an electrical conduction means.

2. A static charge and dust and lint removing device consisting of:

a housing means for enclosing and supporting the elements of the device, said housing means being made of electrically non-conductive material and being generally rectangular in shape and of sufficient depth to enclose the components of the device, said housing means having an inlet opening to allow air to flow into the device and an outlet opening to allow air to flow out of the device, an impeller means within the housing means to receive air from the inlet opening and for accelerating the air to high velocities on the order of 6000 to 7000 feet per minute, said impeller means comprising a circular disc of finite thickness with a central hub for attachment to a rotation means and with veins perpendicular to the plane of the circular disc extending radially from a central region to the circumference of the disc, a rotation means comprising a motor means affixed to the housing means with the motor shaft anchored in the hub of the impeller means such that the motor means will drive the impeller means about its axis of rotation, a scroll means within the housing means for surrounding the impeller means so as to collect and channel the air from the impeller means to a duct means, a duct means within the housing means defining a passageway for the air to flow from the scroll means to an ionizing section and a directing means, said passageway consisting of a single passageway, to allow for the uniform flow of air from the impeller means through the ionizing section and the direction means, said single passageway being continuous therethrough and of appreciably constant cross section and having smooth continuous walls to minimize turbulence in the flow of air therethrough, an ionizing section for the positioning of one or more emitters in the air flow, an emitter means mounted within the ionizing section for inducing an ionized charge to the air passing therethrough, said emitter means consisting of a plurality of fine wires, each less than one ten thousandth of an inch in diameter, formed into a brush and metallically bonded to a supporting means which is also an electrical conductor for providing connection to a high voltage source, a directing means affixed to the outflow opening of the ionizing section for directing the air out of the device and to the work area, an electrical alternating current high voltage source means connected to the emitter means by an electrical conduction means.

3. The devices of claim 1 or claim 2 wherein the impeller means comprises a plurality of centrifugal impellers in series such that the energy imparted to the air by each individual impeller is added to the energy imparted to the air by all previous impellers in the series, said impeller means being driven by a motor means and enclosed within suitable scroll means such that the air from the output of each individual impeller is directed to the input of the next impeller in the series and the output from the last impeller in the series is directed into the duct means.

* * * * *